United States Patent [19]

Stilts

[11] 4,039,098

[45] Aug. 2, 1977

[54] THERMAL INSULATION JACKET FOR WATER HEATERS

[76] Inventor: Kenneth Morris Stilts, P.O. Box 17087, Nashville, Tenn. 37217

[21] Appl. No.: 646,646

[22] Filed: Jan. 5, 1976

[51] Int. Cl.[2] ..... B65D 25/20

[52] U.S. Cl. ..... 220/63 R; 150/52 R; 206/223

[58] Field of Search ..... 220/9 R, 9 A, 11, 63 R, 220/65; 122/494; 219/310, 311, 312; 150/52 R; 206/223

[56] References Cited

U.S. PATENT DOCUMENTS

| | | | |
|---|---|---|---|
| 1,484,056 | 2/1924 | Birtch | 220/63 R |
| 1,605,621 | 11/1926 | Shuell | 122/494 X |
| 1,827,521 | 10/1931 | Heathman | 220/9 A X |
| 1,906,593 | 5/1933 | Higgins | 220/65 X |
| 2,243,249 | 5/1941 | Craig | 122/494 |
| 2,285,830 | 6/1942 | Paget | 220/9 A X |
| 2,365,086 | 12/1944 | Kamowski | 220/63 R |
| 2,371,347 | 3/1945 | Morrow | 220/63 R |
| 2,642,851 | 6/1953 | McFerran | 122/494 |
| 2,671,907 | 3/1954 | Sterling | 220/65 X |
| 3,253,731 | 5/1966 | Fink et al. | 220/9 R |
| 3,866,785 | 2/1975 | Conte | 220/9 D |

FOREIGN PATENT DOCUMENTS

| | | | |
|---|---|---|---|
| 1,184,874 | 3/1970 | United Kingdom | 220/63 R |
| 419,394 | 11/1934 | United Kingdom | 220/9 A |

*Primary Examiner*—Stephen Marcus
*Attorney, Agent, or Firm*—Sherman & Shalloway

[57] ABSTRACT

A thermal insulation jacket for hot water heaters includes a one-piece disc portion for the top of the heater and a wrapper for the body of the heater. Both the disc and wrapper are made of fiberglas and are held on the heater with strips of tape. The disc extends beyond the periphery of the heater and overlies the upper edge of the wrapper.

5 Claims, 5 Drawing Figures

THERMAL INSULATION JACKET FOR WATER HEATERS

BACKGROUND OF THE INVENTION

1. Field of the Invention

This invention relates to thermal insulation, and more particularly, to jackets or the like for conserving heat in hot water heaters.

2. Technical Considerations and Prior Art

Hot water heaters, generally available for home use and other purposes where a relatively small amount of water is heated, are usually not insulated, as well as they might be. Consequently, a great deal of heat is lost to the atmosphere. This, of course, results in high energy consumption and high utility bills. In addition, during warm times of the year, heat from the hot water heater, tends to heat the air near the heater, resulting in discomfort and extra expense, if the building is air-conditioned. Recent increases in the cost of energy has resulted in a need to make devices, such as hot water heaters, more efficient.

An approach to this problem is shown in U.S. Pat. No. 2,365,086 which discloses a thermal insulating jacket for hot water heaters. The jacket disclosed in this patent is, however, not suitable for a mass market, in that the jacket will not fit all sizes of water heaters, and in that the jacket has complicated and expensive configuration. In addition, the jacket does not have an efficient structure for retaining heat, because it is arranged in compartments, and because the portion covering the top of the heater does not overlie the portion wrapped around the periphery of the heater.

OBJECTS OF THE INVENTION

In view of the aforementioned considerations, it is an object of this invention to provide a new and improved thermal insulating jacket for hot water heaters.

It is another object of this invention to provide a new and improved thermal insulating jacket for hot water heaters, in which the jacket is marketed in a configuration, which is readily adaptable to hot water heaters of various sizes and configurations.

It is still another object of the instant invention to provide a new and improved thermal insulating jacket for hot water heaters, which is easy to install over existing hot water heaters.

It is a further object of the instant invention to provide a new and improved thermal insulating jacket for hot water heaters, which is efficient and does not have structure which lowers the general efficiency of the insulating jacket.

SUMMARY OF THE INVENTION

In view of these and other considerations, the instant invention contemplates a thermal insulating jacket for application to a hot water heater, wherein the jacket includes a one piece disc of insulating material which fits on the top of the hot water heater and projects over the edge of the hot water heater, and a wrapper which fits around the hot water heater beneath the projecting portion of the disc.

DETAILED DESCRIPTION

Figure 1:
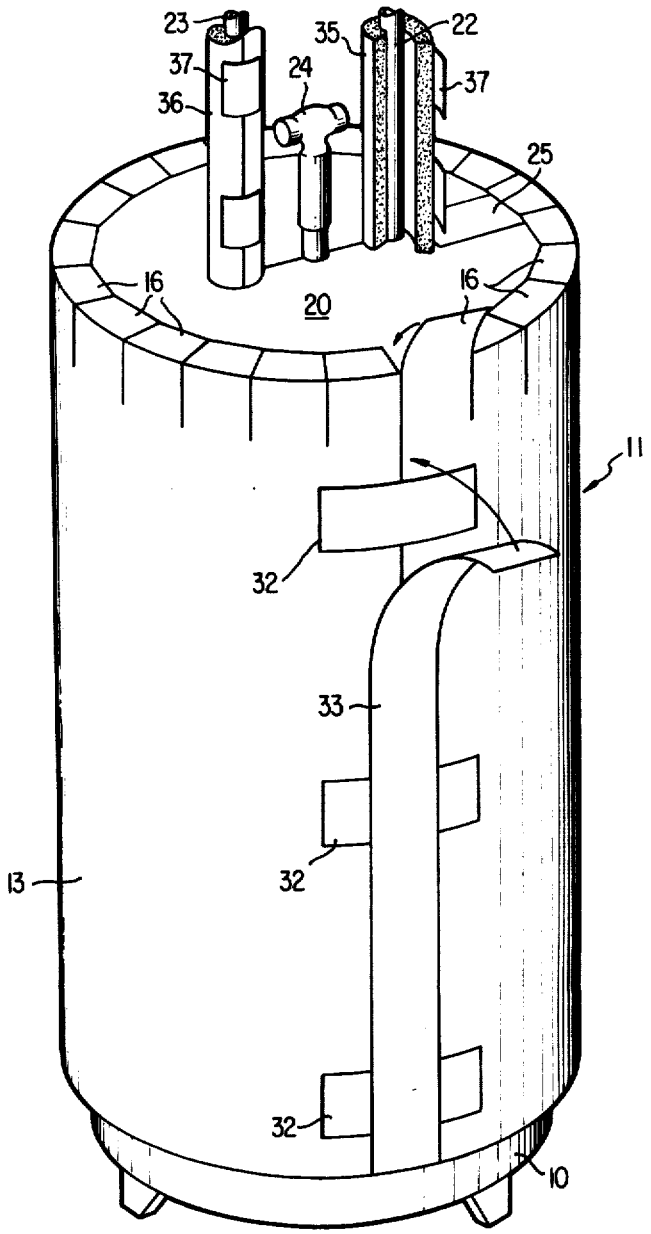
FIG. 1 is a prospective view, showing the thermal insulating jacket of the instant invention, applied to a hot water heater.

Referring now to FIG. 1, there is shown a water heater 10 having a thermal insulating jacket, generally designated by the numeral 11, disposed around a portion thereof. The hot water heater 10 illustrated is cylindrical in cross-section. However, hot water heaters of other cross-sections may conveniently utilize the insulating jacket 11. As is seen in FIG. 1, the bottom portion of the hot water heater may or may not be covered by the jacket. Since heat tends to rise in hot water heaters, it is generally necessary to insulate only the top three quarters of the heater. Accordingly, a jacket with a height of approximately 48 inches will serve almost all hot water heaters installed in homes.

Figure 2:
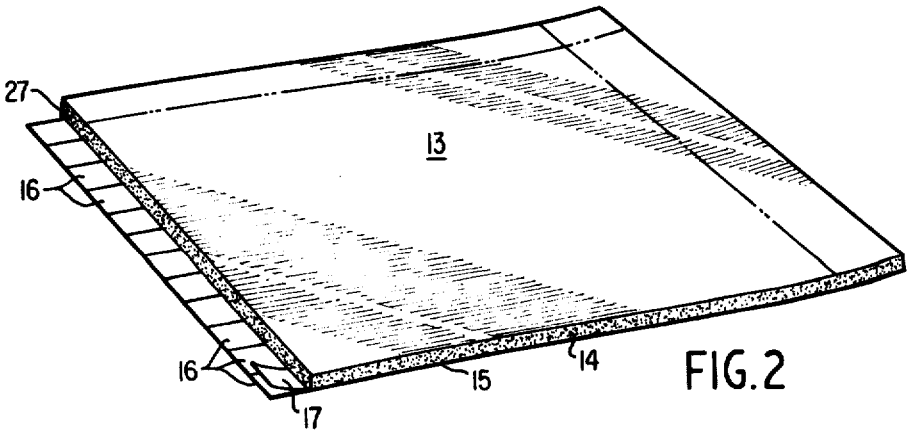
FIG. 2 is a prospective view of a rectangular wrapper, which wraps around the periphery of the hot water heater.

FIG. 2 discloses a wrapper 13 which wraps around the longitudinally extending periphery of the hot water heater 10. The wrapper consists of thermal insulating material 14, which is adhered to a backing 15. The thermal insulating material 14 is perferably fiberglass, while the backing may be of vinyl or heavy paper, such as vinyl "KRAFT" paper, which will withstand considerable abuse and is moisture repellent. The paper backing 15 extends a distance beyond the insulating material 14 and is segmented into a plurality of tabs 16. Each tab 16 is coated on one surface with an adhesive and is protected with a strip of release paper 17 that is removed to expose the adhesive.

Figure 3:
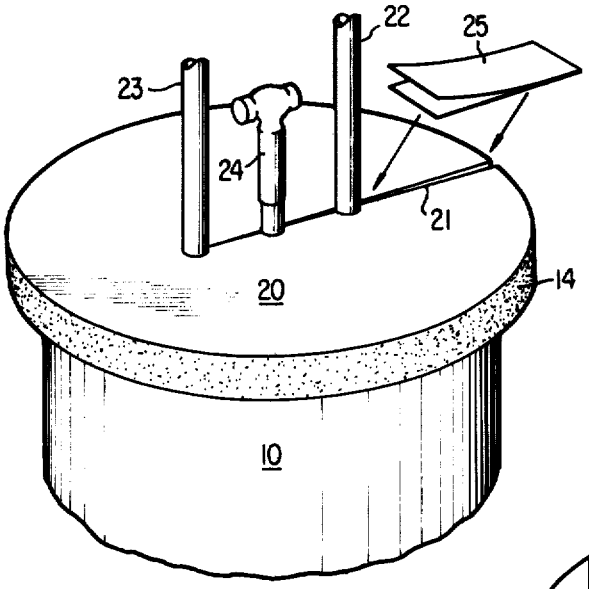
FIG. 3 is a prospective view of a disc of insulating material, which fits over the top of the hot water heater.

Referring now to FIG. 3, there is shown a disc 20 of insulating material 14, which is mounted on the top of the water heater 10. The disc 20 has a slit 21, either formed therein or cut through by the purchaser to accommodate a cold water inlet pipe 22, a hot water outlet pipe 23 and a safety release valve 24. Since the insulating material is fiberglass, which is readily deformable and easily cut, the slit 21 may be easily made to accommodate the pipes 22, 23 and 24. After the disc 20 is mounted on top of the heater 10, a strip of tape 25 is applied over the slit 21 to hold the slit closed. The disc 20 overhangs the heater 10 by approximately 1 ½ inches, which is the thickness of the insulating material in both the wrapper 13 and disc 20. It has been found that a thickness of 1 ½ inches provides sufficient insulating capacity, and allows the wrapper 13 to be wrapped around most household hot water heaters, without undue difficulty.

Figure 4:
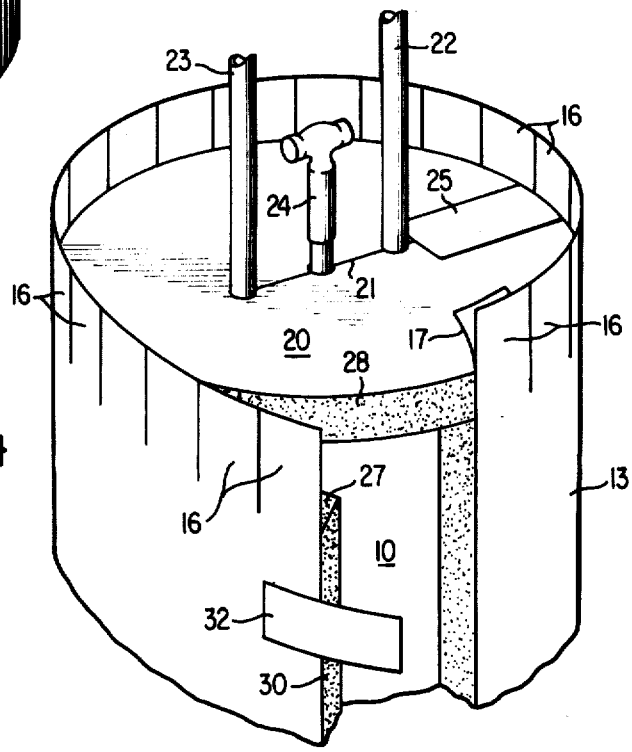
FIG. 4 is a prospective view, showing the wrapper being applied around the periphery of hot water heater.
Figure 5:
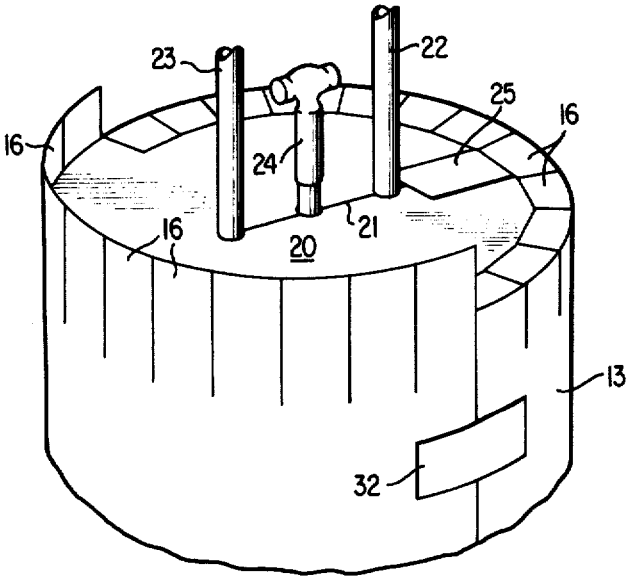
FIG. 5 is a prospective view, showing how the wrapper is secured to the disc, after being wrapped around the heater.

As is seen in FIG. 4, the wrapper 13 is wrapped around the tank 10 with the upper edge 27 of the wrapper disposed beneath the overhanging portion of the disc 20. The tabs 16, which have their adhesive surfaces exposed by removing the release paper 17, adhere to the edge 28 of the disc 20. The tabs 16 are longer than the thickness of the disc 20, so that a portion projects above the disc 20, when the wrapper 13 is applied around the heater 10. This projecting portion is then folded over, as shown in FIG. 5, and adhered to the top of the disc 20. Preferably, the top of the disc 20 is also made of a backing, such as vinyl "KRAFT" paper, so that tabs 16 will readily adhere to the disc and form a good thermal seal, between the disc and wrapper 13.

By disposing the upper edge 27 of the wrapper beneath the overhang of the disc 20, the path between the disc and wrapper extends radially, as oppposed to axially. Heat, of course, will flow less rapidly through a horizontal radial path than a vertical axial path. In addition, the fiberglass in the upper end 27 of the wrapper 13 will tend to expend upwardly and make a tight fit with the fiberglass of the disc 20.

The longitudinal edges 31 and 30 of the blanket 13 are brought into abutment when the blanket is wrapped around the heater 10, and held in abutment by strips of tension tape 32. A longitudinal strip of tape 33 is then applied over the seam 34 formed by the abutment of edges 30 and 31.

As is seen in FIG. 1, it is also desirable to wrap the inlet pipe 22 and outlet pipe 23 with insulation. Accordingly, wrappers 35 and 36 are provided for wrapping these pipes and are held in place on these pipes with strips of tape 37.

In order for the thermal insulating jacket to fit most installed home hot water heaters, the jacket is provided in the form of a kit, which includes the wrapper 13, the disc 20 and wrappers 35 ad 36 for the pipes 22 and 23. In addition, strips if tape are provided to close the seams 34 and 25. The wrapper 13 preferably has a width of 86 ½ inches for wrapping around the heater 10 and a height of 48 inches for covering a substantial portion of the height of the hot water heater. The disc has a diameter of 27 inches. Both the disc and the wrapper are cut by the customer to fit the particular hot water heater to which they are to be applied.

Various chages may be made in the form of the invention illustrated and described herein, without departing from the spirit of the invention, which is limited only by the following appended claims.

What is claimed is:

1. A thermal insulating jacket for application to both the top and longitudinal periphery of a home hot water heater which has pipes extending from the top surface thereof, said jacket comprising:

a substantially flat, one-piece disc having top and bottom surfaces and composed of a continuous layer of fiberglass of a constant thickness wherein a sheet material backing is adhered to the top surface, a slit extending entirely through the disc from the periphery of the disc past the center of the disc and terminating before again reaching the periphery of the disc, said slit having abutting parallel sides wherein the pipes project through the slit and are engaged by the sides of the slit, the bottom surface of said disc projecting beyond the periphery of the hot water heater a distance substantially equal to the thickness of the disc;

a rectangular wrapper for application around the longitudinal periphery of the hot water heater, said wrapper having an upper edge joined by side edges, said wrapper being made of a continuous layer of fiberglass of constant thickness, equal to the thickness of the fiberglass layer of the disc, wherein the fiberglass is adhered to a backing sheet and wherein the wrapper is readily foldable and also wraps in a single layer around the longitudinal periphery of the tank so that the projecting bottom surface of the disc overlies the upper edge of the wrapper and the side edges of the wrapper meet;

a plurality of tabs extending from the upper edge of the wrapper a distance greater than the thickness of the disc, and an adhesive on the tabs so that when the tabs are folded over the disc, the tabs adhere to the disc retaining the upper edge of the wrapper in engagement with the disc, and strips of tape for closing and sealing the slit in the disc and for holding the opposite edges of the wrapper together to thereby seal the wrapper where the side edges meet.

2. The thermal insulating jacket of claim 1, wherein the wrapper extends at least three quarters the height of the heater down from the top of the heater.

3. The thermal insulating jacket of claim 1, further including fiberglass wrappers for the pipes extending from the heater.

4. The thermal insulating jacket of claim 1 wherein the fiberglass in 1 ½ inches thick.

5. The thermal insulating jacket of claim 4, wherein the wrapper is made from a rectangle having a width of approximately 86 inches and a length of approximately 48 inches, and wherein the disc is made from a circular member having a diameter of 27 inches.

* * * * *